US012144390B1

(12) United States Patent
Stewart

(10) Patent No.: US 12,144,390 B1
(45) Date of Patent: Nov. 19, 2024

(54) PROTECTIVE HEADWEAR

(71) Applicant: Blueprint Psychological Services LLC, Phoenix, AZ (US)

(72) Inventor: Laura Stewart, Phoenix, AZ (US)

(73) Assignee: Blueprint Psychological Services LLC, Phoenix, AZ (US)

( * ) Notice: Subject to any disclaimer, the term of this patent is extended or adjusted under 35 U.S.C. 154(b) by 0 days.

(21) Appl. No.: 18/770,414

(22) Filed: Jul. 11, 2024

Related U.S. Application Data

(60) Provisional application No. 63/658,481, filed on Jun. 11, 2024.

(51) Int. Cl.

| | |
|---|---|
| ***A42B 1/08*** | (2006.01) |
| ***A42B 1/0182*** | (2021.01) |
| ***A42B 1/0188*** | (2021.01) |
| ***A42B 1/24*** | (2021.01) |
| *A63B 57/20* | (2015.01) |

(52) U.S. Cl.
CPC ..... *A42B 1/08* (2013.01); *A42B 1/0182* (2021.01); *A42B 1/0188* (2021.01); *A42B 1/24* (2013.01); *A63B 57/203* (2015.10)

(58) Field of Classification Search
CPC ..... A42B 1/08; A42B 1/0182; A42B 1/0188; A42B 1/24
See application file for complete search history.

(56) References Cited

U.S. PATENT DOCUMENTS

| | | | | | |
|---|---|---|---|---|---|
| 1,345,933 | A * | 7/1920 | Knight | A42B 1/08 | 2/412 |
| 1,673,859 | A * | 6/1928 | Wittcoff | A42B 1/02 | 2/10 |
| 2,222,096 | A * | 11/1940 | Walthour, Jr. | A42B 1/24 | 43/57.1 |
| 2,597,601 | A * | 5/1952 | Sherman | A42B 1/24 | 224/183 |
| 2,769,272 | A * | 11/1956 | Goldman | A42B 1/24 | 2/209.13 |
| 2,795,890 | A * | 6/1957 | Metsker | A01K 97/06 | 43/57.1 |
| 4,114,201 | A * | 9/1978 | Garrison | A42B 1/0182 | 2/209.7 |
| 4,275,930 | A * | 6/1981 | Kamihama | B60B 7/18 | 301/37.29 |
| 4,439,871 | A * | 4/1984 | Plastino | A42B 1/08 | 2/418 |
| 4,581,773 | A * | 4/1986 | Cunnane | A42B 1/08 | 2/204 |

(Continued)

*Primary Examiner* — Khaled Annis
(74) *Attorney, Agent, or Firm* — Law Offices of Damon L. Boyd, PLLC

(57) ABSTRACT

Protective headwear comprising an elliptical crown with an upper end and a lower end, a top with an energy absorbing core layer adjacent thereto and wherein the top is attached to the upper end of the elliptical crown, a brim attached to the lower end of the elliptical crown and wherein a protective cage is coincident with the elliptical crown, and protective structural ribs coplanar with the brim. The protective headwear may comprise a fitting insert. The protective headwear may comprise an engagement strap, and when the engagement strap is pulled, it bends the brim towards a user's head. The protective headwear may comprise a belt with a holder for one or more golf tees and/or pencils.

10 Claims, 11 Drawing Sheets

(56) References Cited

U.S. PATENT DOCUMENTS 5,437,064 A * 8/1995 Hamaguchi ..... A42B 1/08 2/909
5,548,846 A * 8/1996 Bianchetti ..... A42B 1/0184 2/209.12
5,729,830 A * 3/1998 Luhtala ..... F41H 1/00 2/200.1
5,857,219 A * 1/1999 Edmark ..... A42B 1/201 2/182.2
5,887,289 A * 3/1999 Theoret ..... A42B 3/003 2/425
6,484,323 B1 * 11/2002 Pu ..... A42B 1/24 2/171.1
6,704,940 B1 * 3/2004 Convery ..... A42B 1/206 2/175.1
7,010,814 B2 * 3/2006 Benziger ..... A63B 23/025 2/171.2
8,108,944 B1 * 2/2012 Gilson, Sr. ..... A42B 1/24 2/209.3
8,978,167 B2 * 3/2015 Blair ..... A42B 1/08 2/410
9,480,292 B1 * 11/2016 Kazmierczak ..... A42C 5/04
9,693,594 B1 * 7/2017 Castro ..... A42B 1/08
10,004,290 B2 * 6/2018 Copeland ..... A42B 1/02
10,098,398 B2 * 10/2018 Lacy ..... A42B 1/201
10,130,134 B2 * 11/2018 Blair ..... A42B 3/128
10,390,582 B2 * 8/2019 Copeland ..... A42B 1/02
10,820,651 B1 * 11/2020 Armendariz ..... A42B 1/06
11,375,765 B2 * 7/2022 Bryan ..... A42B 3/0406
11,576,453 B2 * 2/2023 Sunseri ..... A42B 1/22
2001/0025385 A1 * 10/2001 Montague ..... A42B 1/22 2/175.1
2002/0100106 A1 * 8/2002 Simmons ..... A42C 5/04 2/171.2
2002/0162160 A1 * 11/2002 Anderson ..... A42B 1/22 2/200.1
2004/0163162 A1 * 8/2004 Benziger ..... A63B 23/025 2/413
2005/0050613 A1 * 3/2005 Legg ..... A42B 1/24 2/209.13
2007/0000025 A1 * 1/2007 Picotte ..... A42B 3/121 2/171
2008/0060117 A1 * 3/2008 Timms ..... A42B 3/12 2/171
2008/0083053 A1 * 4/2008 Lin ..... A42B 3/003 2/175.1
2008/0189828 A1 * 8/2008 Moss ..... A42B 1/24 2/175.1
2010/0122401 A1 * 5/2010 Thompson ..... A42B 1/24 2/243.1
2011/0307997 A1 * 12/2011 Blair ..... A42B 3/128 2/414
2012/0030860 A1 * 2/2012 Lovitz ..... A42B 1/004 2/209.13
2014/0059746 A1 * 3/2014 Olivares Velasco ... A41D 3/005 2/414
2015/0150328 A1 * 6/2015 Knight ..... A42C 5/04 2/175.1
2017/0164677 A1 * 6/2017 Olivares Velasco ..... A42B 3/10
2017/0172244 A1 * 6/2017 Lacy ..... A42B 7/00
2019/0037953 A1 * 2/2019 Holguin ..... A42B 1/0182
2019/0082763 A1 * 3/2019 Seela ..... A42B 1/08
2019/0297982 A1 * 10/2019 Denny ..... A42B 1/004
2020/0375532 A1 * 12/2020 Nath ..... A61B 5/6803
2021/0100307 A1 * 4/2021 Sunseri ..... A42B 1/18
2021/0321690 A1 * 10/2021 Travis ..... A42B 1/0181
2022/0346482 A1 * 11/2022 Hodgdon ..... A42B 1/0186

* cited by examiner

PROTECTIVE HEADWEAR

CROSS REFERENCE TO RELATED APPLICATION

This Patent Application is related to and claims priority under 35 U.S.C. § 119(e) to U.S. Provisional Patent Application No. 63/658,481, entitled "PROTECTIVE HEADWEAR," filed Jun. 11, 2024, which is incorporated by reference in its entirety for all purposes.

TECHNICAL FIELD

The present disclosure relates generally to protective headwear.

BACKGROUND

Most sports require some sort of protective gear to prevent injury. However, with respect to golf, one of the most popular sports in the world, very little protective gear is offered, and indeed, the golf industry does not even promote or discuss the need for protective gear for its athletes. This lack of gear and messaging exists in spite of consistent statistics showing a 15.8% to 40.9% rate of golf ball injury to amateur golfers, with an increased risk as high as 67.7% in professional golfers (British Journal of Sports Medicine, 2016). The magazine Golf Digest has reported that each year, an estimated 40,000 golfers seek emergency treatment due to errant golf balls and flying clubs.

Golf ball strikes to the head cause some of the more serious injuries and the severity of these injuries cannot be underestimated. The inventor, a clinical psychologist, has worked with numerous patients who have suffered from Mild Traumatic Brain Injury and Traumatic Brain Injury (MTBI) and traumatic brain (TBI) injuries, including those resulting from golf ball strikes. Such injuries can be devastating to the victim of the injury as well as the family of the victim. As the popularity of golf increases, unless the accessibility to protective gear and consistent messaging regarding safer golfing occurs, it is expected these numbers and the corresponding injuries will increase.

While there is existing headwear that might be used to protect golfers, these are products from other industries such as bulky helmets (e.g., baseball, football, etc.), hard hats (e.g., construction), these tend to be uncomfortable when worn while golfing, particular in warm or hot weather, and are generally not aesthetically pleasing. Moreover, because golfers play in a variety of weather, existing protective headwear lacks needed features such as protection from the sun (to provide shade and protection from sunburn), wind (can be secured to golfer's head), and rain. Additionally, existing headwear is not quickly "adaptable" to provide increased protection to the golfer's face and other portions of the golfer's head.

Accordingly, improved protective headwear offering features such as those described above is desirable.

SUMMARY

The present disclosure provides protective headwear comprising an elliptical crown with an upper end and a lower end and a top with an energy absorbing core layer adjacent thereto. The top is attached to the upper end of the elliptical crown and the brim is attached to the lower end of the elliptical crown. A protective cage is generally coincident with the elliptical crown and protective structural ribs are generally coplanar with the brim. The protective headwear may comprise a fitting insert. The protective headwear may comprise an engagement strap, and when the engagement strap is pulled, it bends the brim towards a user's head. The protective headwear may further comprise a belt for additional protection and may further comprise a holder for one or more golf tees, pens, pencils, divot tools and the like.

BRIEF DESCRIPTION OF THE DRAWINGS

The accompanying drawings are included to provide a further understanding of the disclosure and are incorporated in and constitute a part of this specification, illustrate embodiments of the disclosure, and together with the description serve to explain the principles of the disclosure, wherein.

DETAILED DESCRIPTION OF THE ILLUSTRATED EMBODIMENTS

Figure 1:
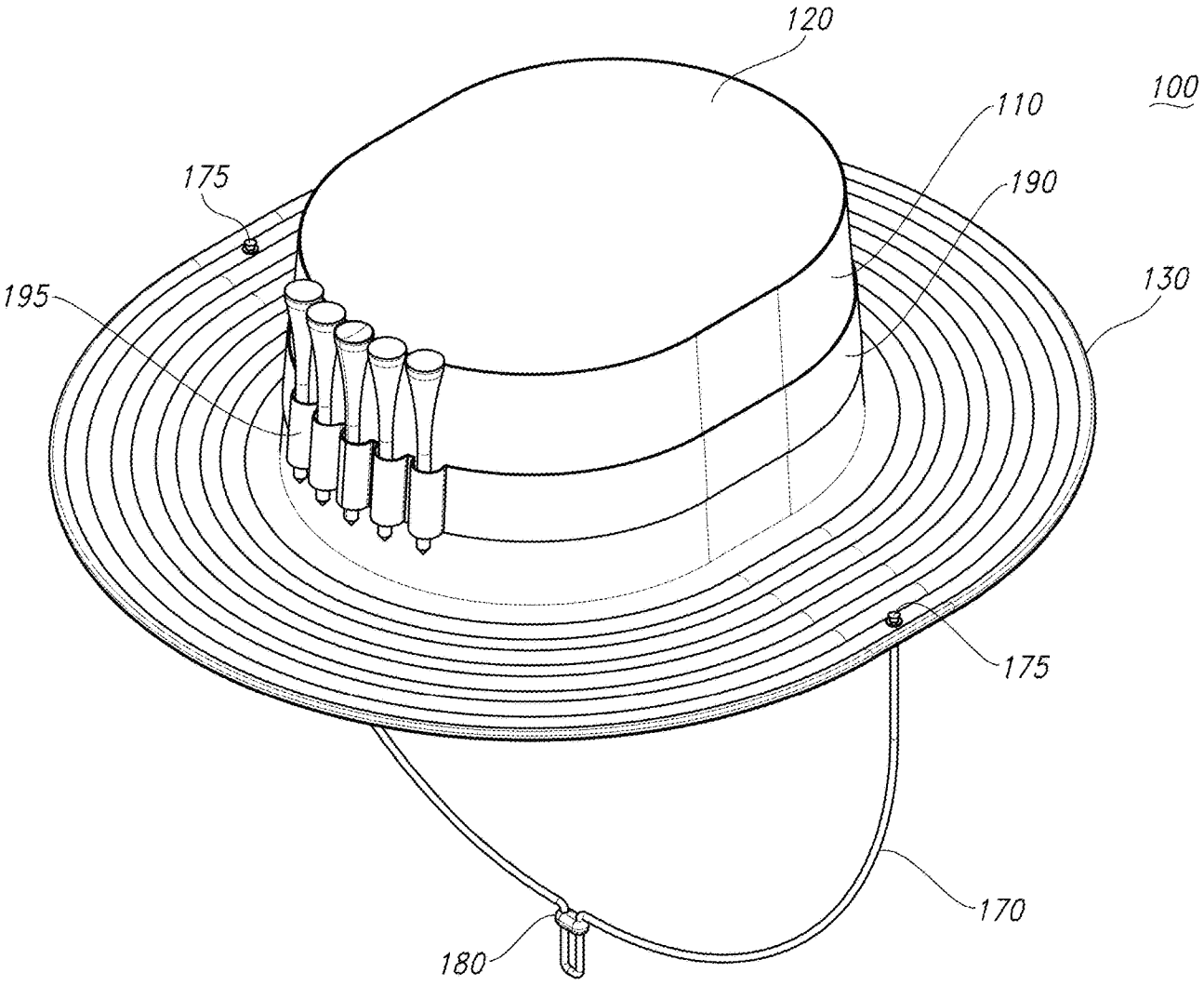
FIG. 1 is a top perspective view of headwear in accordance with the present disclosure.
Figure 2:
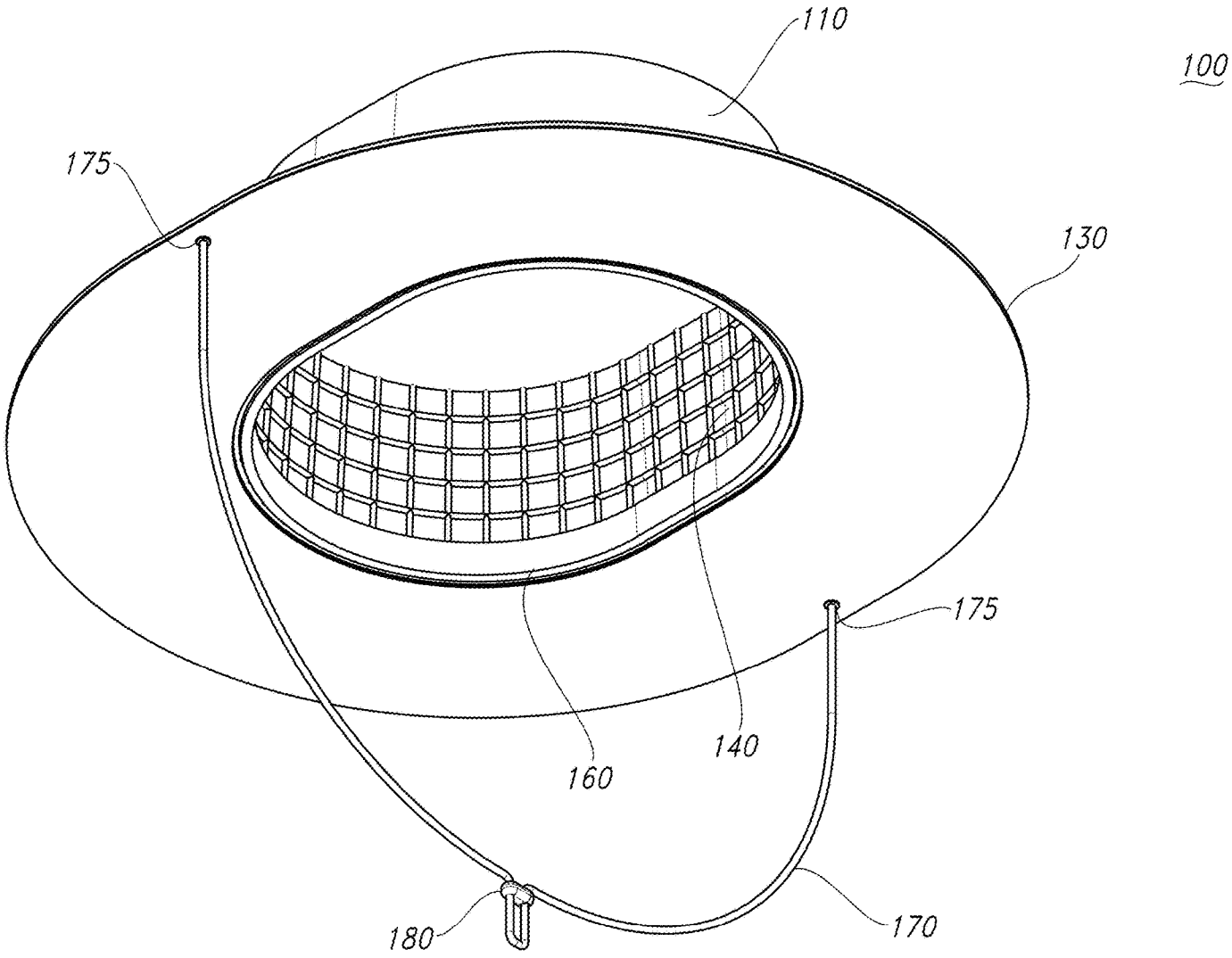
FIG. 2 is a bottom perspective view of headwear of the headwear of FIG. 1 in accordance with the present disclosure.
Figure 3:
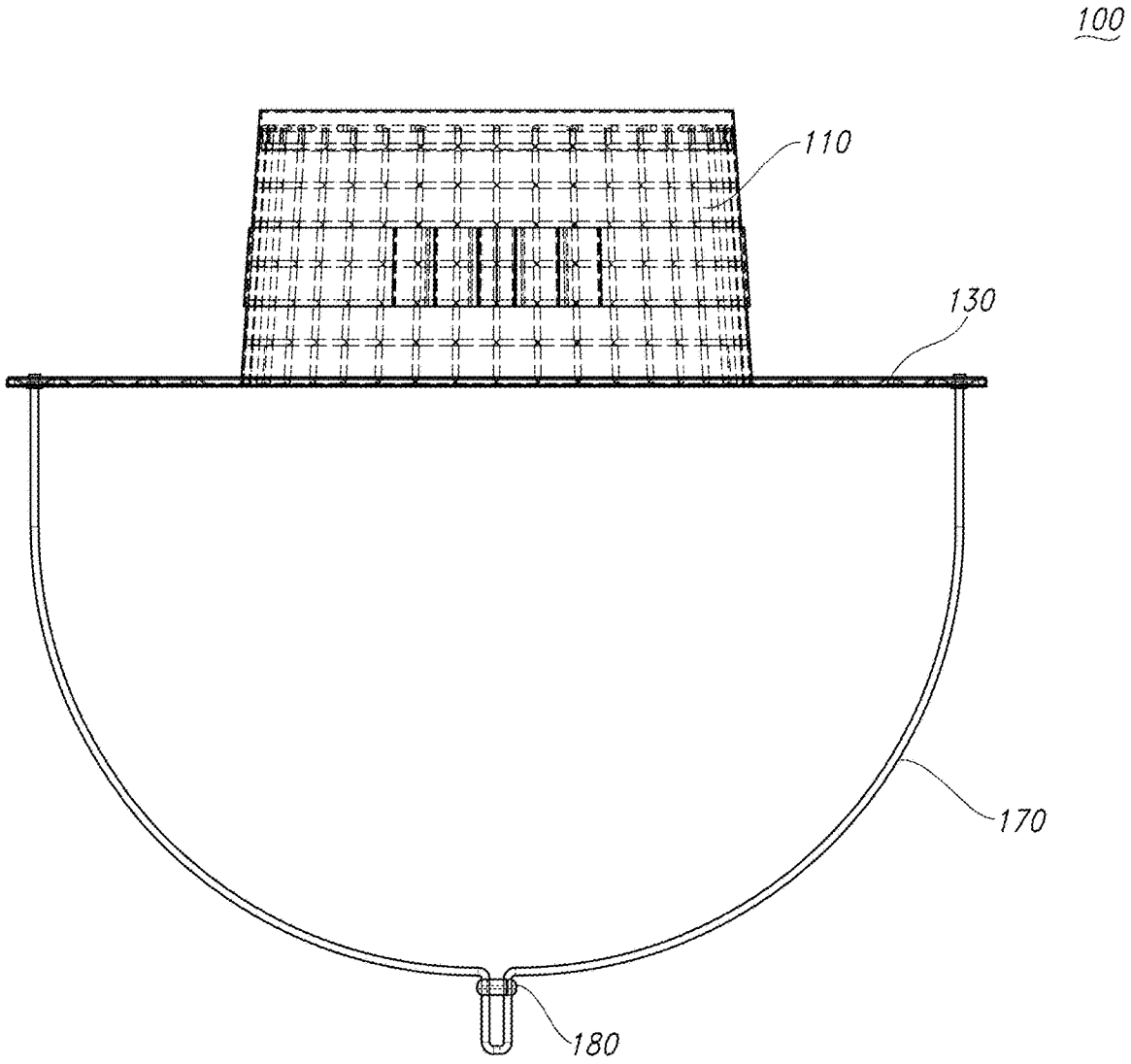
FIG. 3 is a front view of headwear of the headwear of FIG. 1 in accordance with the present disclosure.
Figure 4:
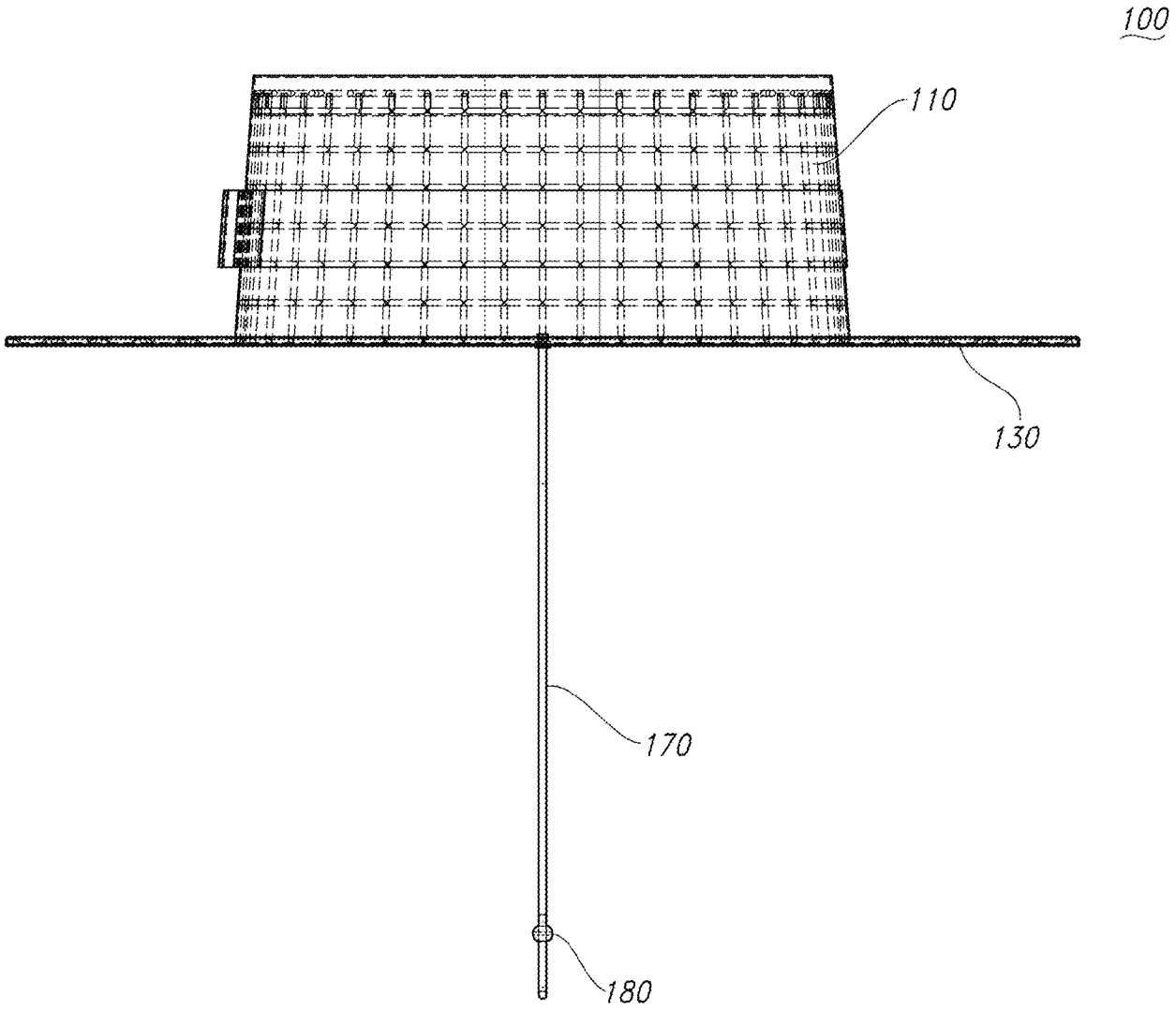
FIG. 4 is a side view of headwear of the headwear of FIG. 1 in accordance with the present disclosure.
Figure 5:
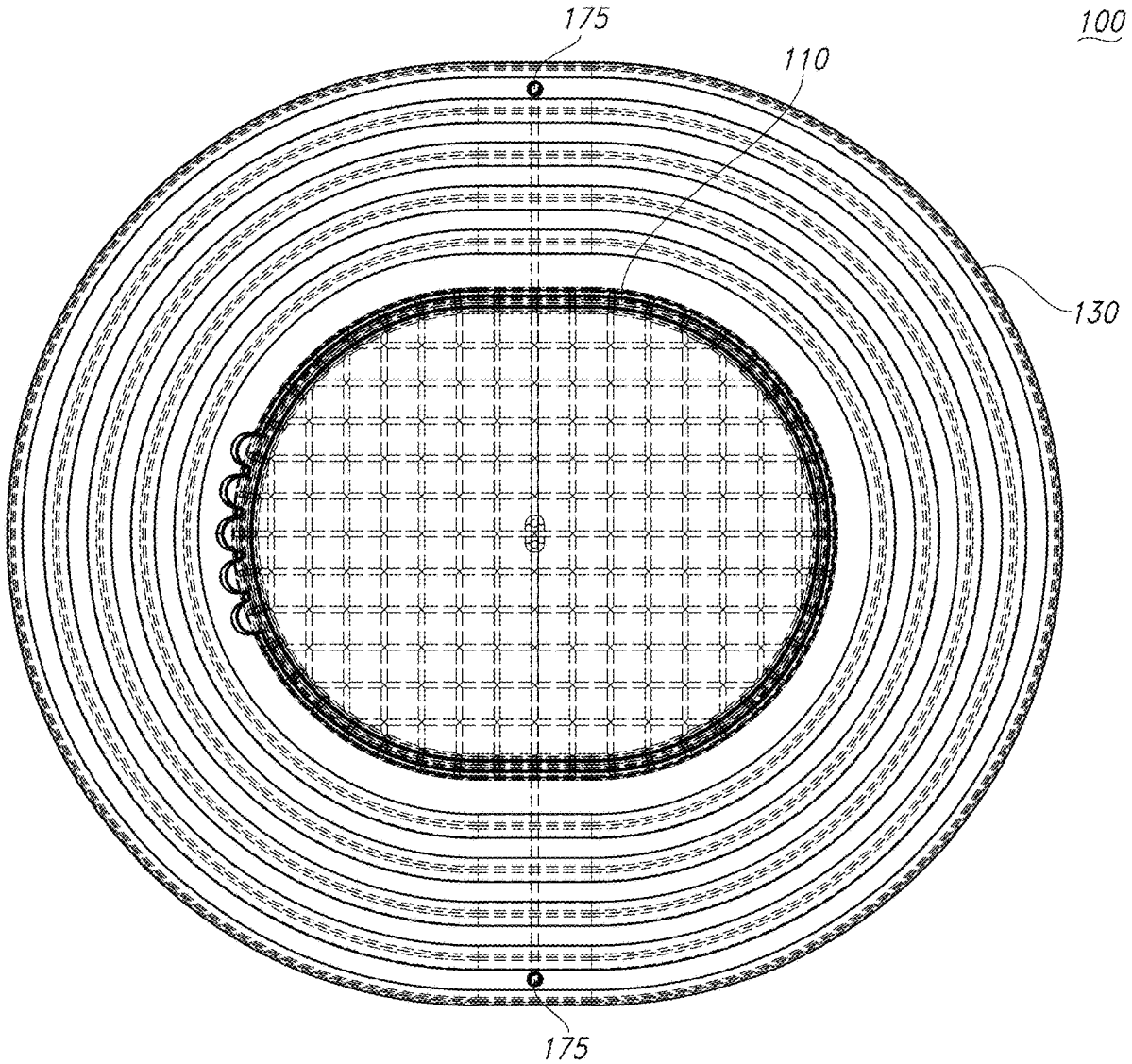
FIG. 5 is a top view of headwear of the headwear of FIG. 1 in accordance with the present disclosure.
Figure 6:
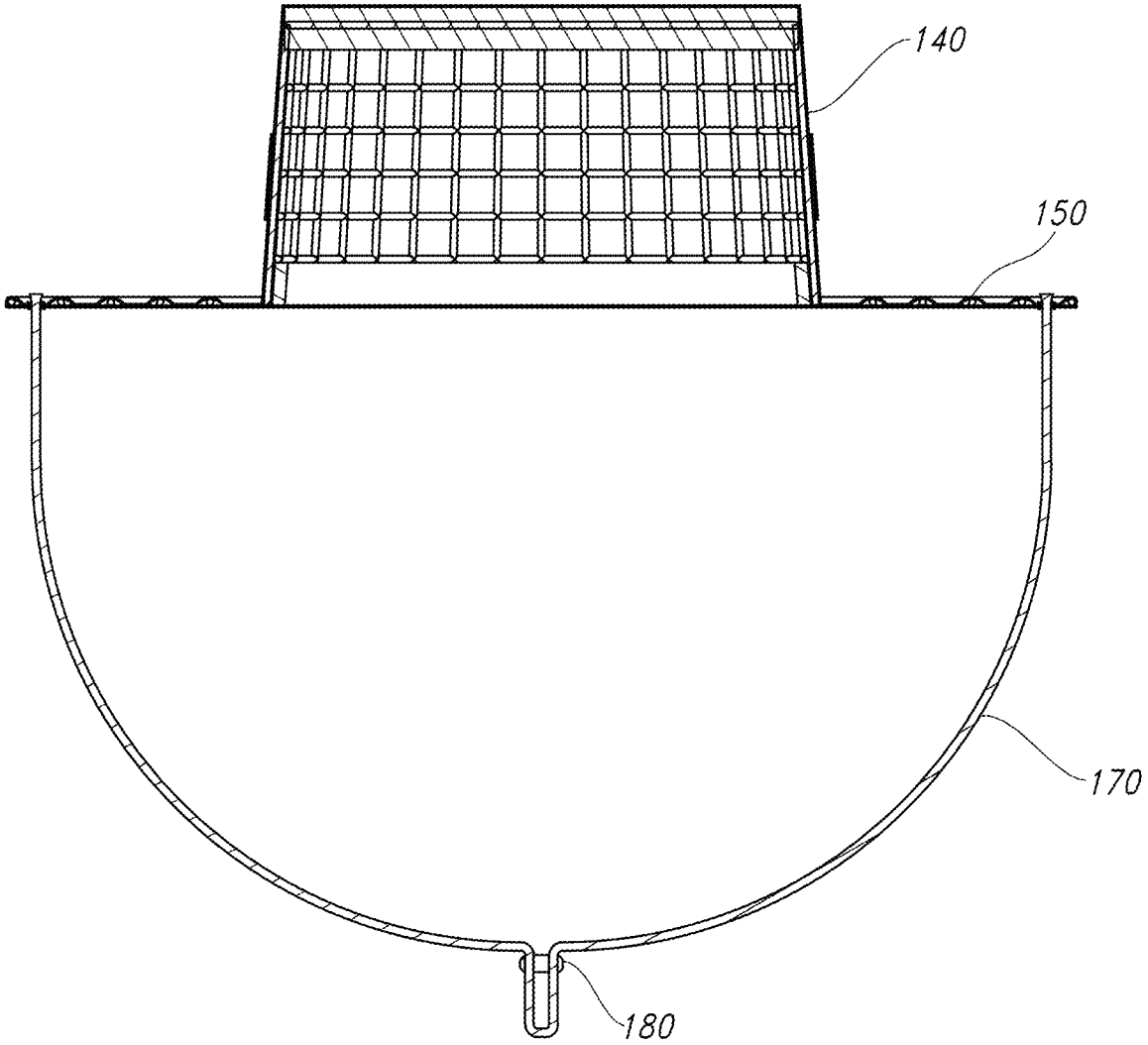
FIG. 6 is a front view showing the inner protective structure of the headwear of FIG. 1 in accordance with the present disclosure.
Figure 7:
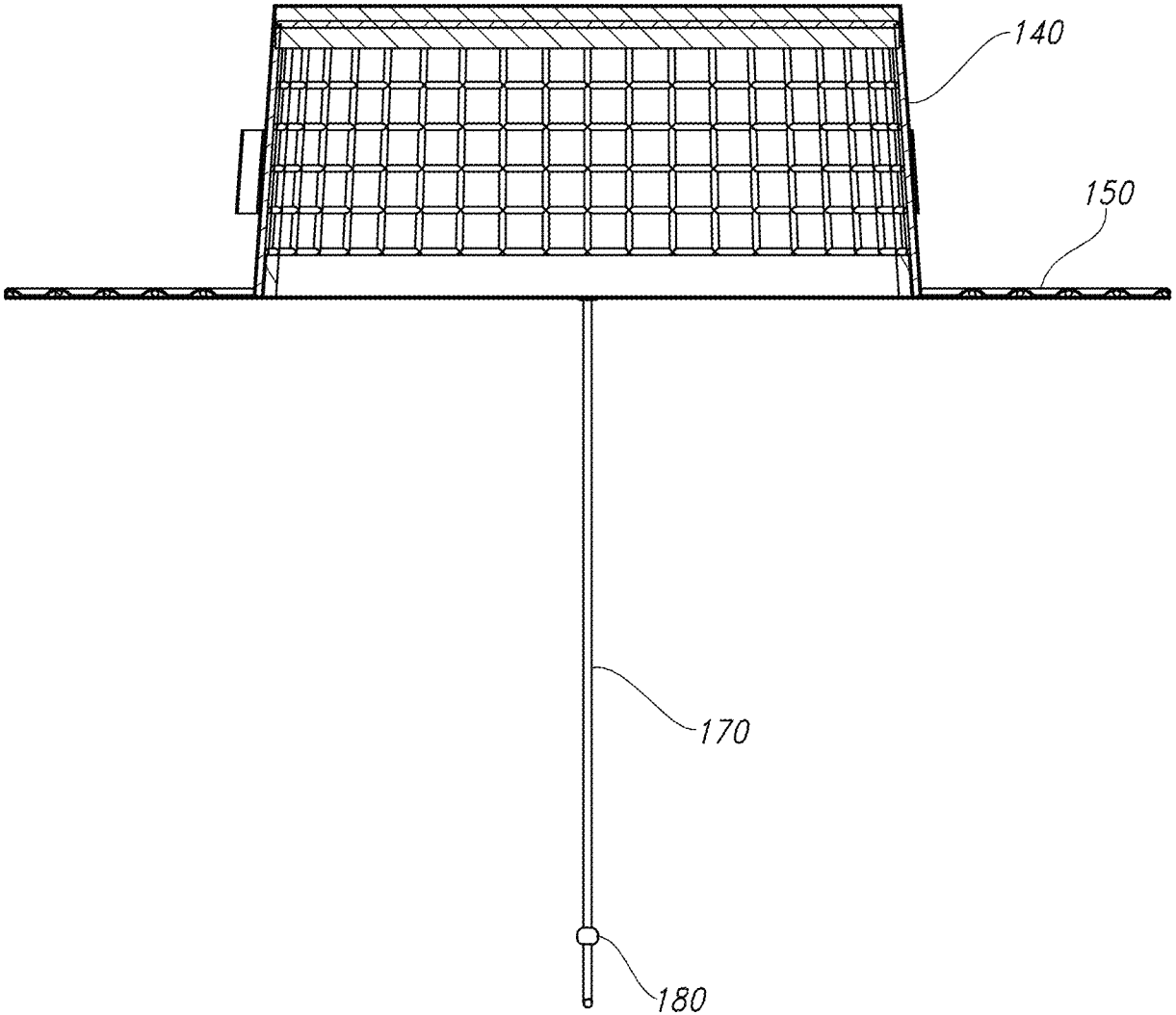
FIG. 7 is a side view showing the inner protective structure of the headwear of FIG. 1 in accordance with the present disclosure.

Persons skilled in the art will readily appreciate that various aspects of the present disclosure can be realized by any number of methods and systems configured to perform the intended functions. Stated differently, other methods and systems can be incorporated herein to perform the intended functions. It should also be noted that the accompanying drawing figures referred to herein are not all drawn to scale but may be exaggerated to illustrate various aspects of the present disclosure, and in that regard, the drawing figures should not be construed as limiting. Finally, although the present disclosure can be described in connection with various principles and beliefs, the present disclosure should not be bound by theory.

In general, the present disclosure provides devices, systems and methods for protective headwear which may be particularly useful in the context of golf, but likewise may have usefulness in connection with other sports and activities where protecting the head is important (e.g., spectators at golf tournaments, baseball and softball games, or any other event where there may be projectiles that could injure someone). Additionally, the protective headwear may be particularly important for children and young adults that may be "less aware" of their surroundings and/or may be more susceptible to head injury.

In accordance with various aspects of the present invention, the protective headwear is aesthetically pleasing and not generally apparent that it has underlying protective functionality that can alleviate or even eliminate head injuries for golfers of all ages. In this regard, the protective headwear may resemble a typical "bucket hat" yet have hidden or camouflaged protective infrastructure to that deters and/or deflects errant golf balls (or other projectiles, depending how used).

In addition to the passive protection the protective headwear provides while being worn, the protective headwear also features a "quick engagement" engagement strap that allows the golfer to quickly pull the structurally reinforced protective sides of the brim down over the sides and back of the head, allowing for the protective headwear to protect the most vulnerable areas of the head and brain-something for which a typical hat is not capable.

The above being noted, in accordance with various aspects of the present disclosure and with reference to the accompanying FIGS. 1-8, protective headwear 100, comprising an elliptical crown 110 with an upper end 105 and a lower end 115, a top 120, and a brim 130 are provided. The top 120 is attached to the upper end 105 of the elliptical crown 110 and the brim 130 is attached to the lower end 115 of the elliptical crown 110, thus resembling a typical bucket hat. The materials of the protective headwear 100, including the elliptical crown 110, the top 120, and the brim 130, as well as other components of the protective headwear generally comprise any suitable flexible material. For example, various fabrics, cloth, and canvas materials, natural (e.g., wool, cotton, bamboo, etc.) or synthetic (e.g., nylon, polyester, etc.) may be used. In various embodiments, the materials may also be breathable and/or waterproof for comfort and protection from the elements.

In accordance with various aspects of the present disclosure, a core layer 125 is provided adjacent to the top 120. The core layer 125 comprises an energy absorbing material such as a foam or similar material. The core layer 125 may be about 0.5 inches thick, though depending on the material and needs, the thickness may vary. Additional layers of various materials and/or protective structures such as the cage and structural ribs described below may also be provided for additional protection.

In accordance with various aspects of the present disclosure, the protective headwear 100 further comprises a cage 140 generally coincident with the elliptical crown 110. The cage 140 is a suitably rigid structure that provides additional protection on the sides of a user's head. In accordance with various aspects, the cage 140 is inside the elliptical crown 110 or "sandwiched" between layers forming the elliptical crown 110 so that it cannot be seen. However, in accordance with other aspects, the cage 140 may be on the outside the elliptical crown 110, either disguised or camouflaged or even integrated as a pattern on the protective headwear 100.

In accordance with various aspects of the present disclosure and with particular reference to FIGS. 9-12, the cage 140 comprises a rigid or a semi-rigid material capable of deflecting and/or absorbing the energy of a golf ball, other projectile, or similar blow. For example, the cage 140 may comprise a variety of (preferably lightweight) plastics, polymers, or the like, though other suitably rigid, yet still lightweight materials such as some metals (aluminum, titanium, etc.) or other natural materials may be used. The cage may have a rectangular (grid) or diamond pattern, or other suitable configuration.

In accordance with various aspects of the present disclosure and with particular reference to FIGS. 13-16, the protective headwear 100 comprises structural ribs 150 generally coplanar with the brim 130. The structural ribs 150 are suitably rigid structures that provide additional protection in the brim 130 on the sides of a user's head, particularly when engaged as described below.

In accordance with various aspects, the structural ribs 150 may be attached below or "sandwiched" between layers forming the brim 130*a*, 130*b* (e.g., FIG. 8) so that the structural ribs 150 cannot be seen. However, in accordance with other aspects, like the embodiment of the cage 140 described above, the structural ribs 150 may also be above the brim 130, either disguised or camouflaged or even integrated as a pattern on the protective headwear 100.

In accordance with various aspects, the structural ribs 150 preferably comprise a semi-rigid material so that they may bend to cover the sides of a user's head when desired by a user, yet still provide protection (as described below). In accordance with various aspects, the structural ribs 150 may have any suitable confirmation, such as circumferential, an array, a grid, or any combination of the forgoing.

In accordance with various aspects of the present disclosure, the protective headwear 100 further comprises a fitting insert 160. The fitting insert 160 is an insert for so that the protective headwear 100 appropriately and comfortably fits the use using the protective headwear 100. The fitting insert 160 may be adjustable to accommodate different size heads and head shapes of different users. In accordance with various aspects, the fitting insert 160 may be adjustable. In accordance with various aspects of the present disclosure, the fitting insert 160 may also cover attachment points of the circumference of the brim 130 and the lower portion of cage 140 for further stability and diffusion of energy during a strike from ball or other projectile. In this regard, a lower portion of the cage 140 interweaves with an inner portion of the brim 130, thus creating one flexible yet cohesive unit. In accordance with various aspects, the fitting insert 160 may also be removable and/or replaceable to account for cleaning and wear and tear. The fitting insert 160 may also provide a wicking effect to absorb sweat from the user.

Figure 8:
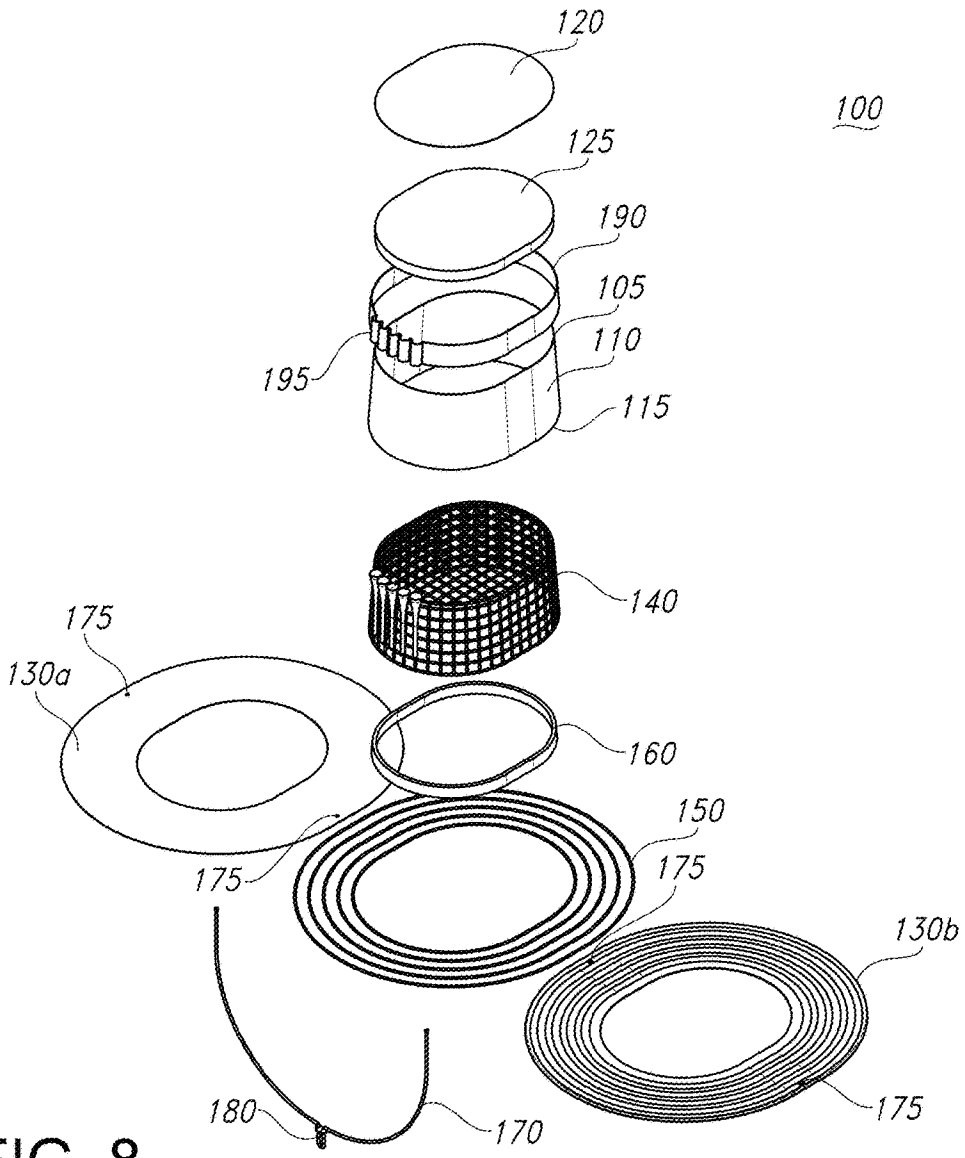
FIG. 8 is an exploded top perspective view of the components of the headwear of FIG. 1 in accordance with the present disclosure.
Figure 9:
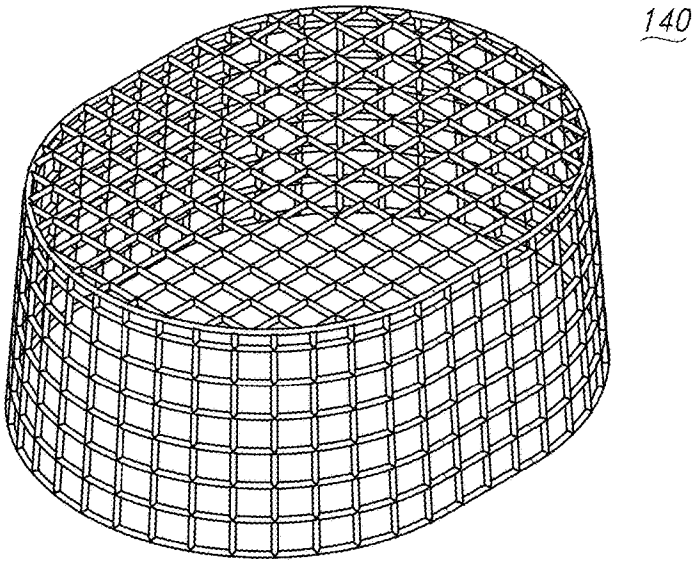
FIG. 9 is a perspective view of the cage of the headwear of FIG. 1 in accordance with the present disclosure.
Figure 11:
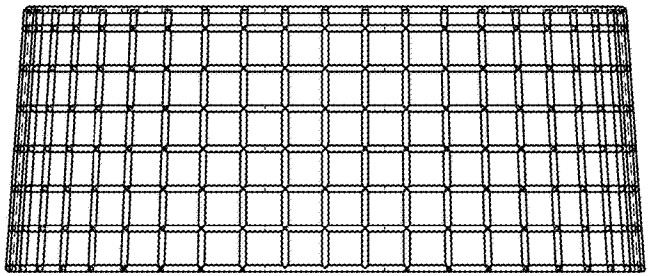
FIG. 11 is a side view of the cage of the headwear of FIG. 1 in accordance with the present disclosure.
Figure 12:
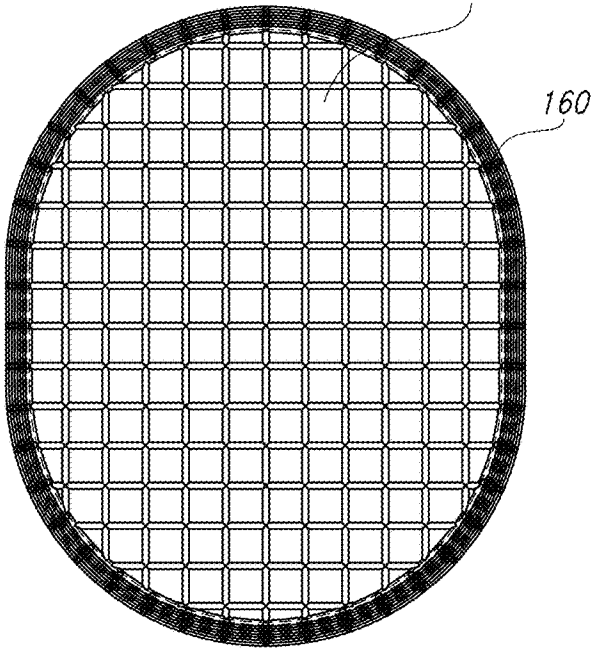
FIG. 12 is a top view of the cage and a fitting insert of the headwear of FIG. 1 in accordance with the present disclosure.
Figure 10:
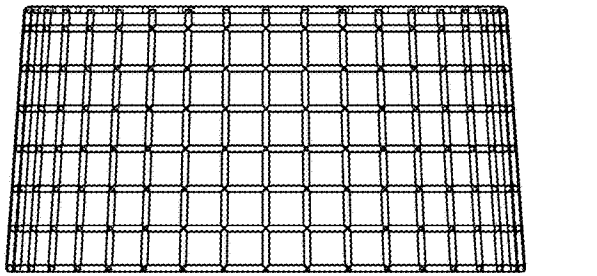
FIG. 10 is a front view of the cage of the headwear of FIG. 1 in accordance with the present disclosure.
Figure 13:
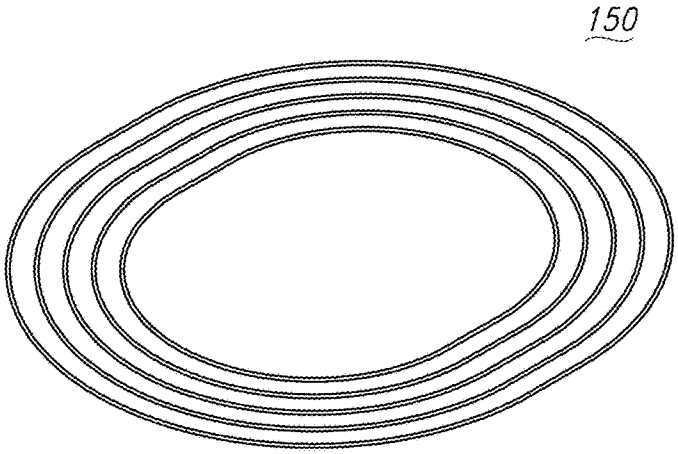
FIG. 13 is a top perspective view of the circumferential ribs of the brim of the headwear of FIG. 1 in accordance with the present disclosure.
Figure 15:
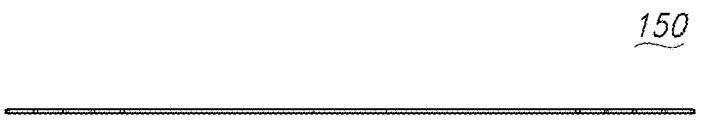
FIG. 15 is a side view of the circumferential ribs of the brim of the headwear of FIG. 1 in accordance with the present disclosure.
Figure 16:
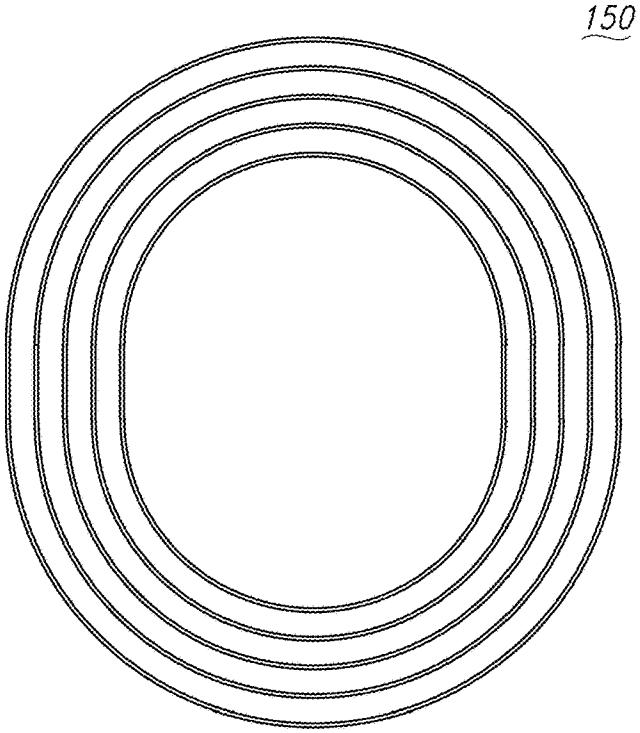
FIG. 16 is a top view of the circumferential ribs of the brim of the headwear of FIG. 1 in accordance with the present disclosure.
Figure 14:
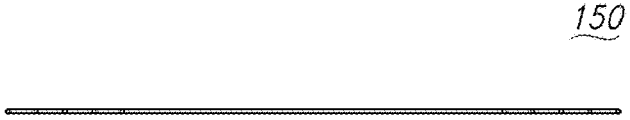
FIG. 14 is a front view of the circumferential ribs of the brim of the headwear of FIG. 1 in accordance with the present disclosure.

In accordance with various aspects of the present disclosure, the protective headwear 100 comprises an engagement strap 170. The engagement strap 170 may be any conventional lanyard-style cord connected to the brim 130 of the protective headwear 100. As shown in FIG. 8, the ends of engagement strap 170 pass through the brim 130 (or layers of the brim 130*a*, 130*b*), for example via holes 175 in the brim 130, and securely attach to structural ribs 150, which as described in more detail below, helps facilitate quick engagement of additional protection. The engagement strap 170 can loop around a user's neck and hang on the user's neck when not being worn.

The engagement strap 170 may also further comprise a cord lock 180 for tightening the engagement strap 170. In such embodiments, the cord lock 180 is drawn up and tightened proximate a user's chin to secure the protective headwear 100 in place, for example, when there is wind or, in the case of golf, during a swing. In accordance with various aspects, conventional spring activated cord locks 180 may be used. Such conventional spring activated cord locks 180 operate by depressing a button on the cord lock 180 so that the cord lock may freely slide up and down the engagement strap 170 to tighten or loosen the engagement strap 170, and upon releasing the button, a spring maintains the cord lock 180 at a desired location.

Figure 17:
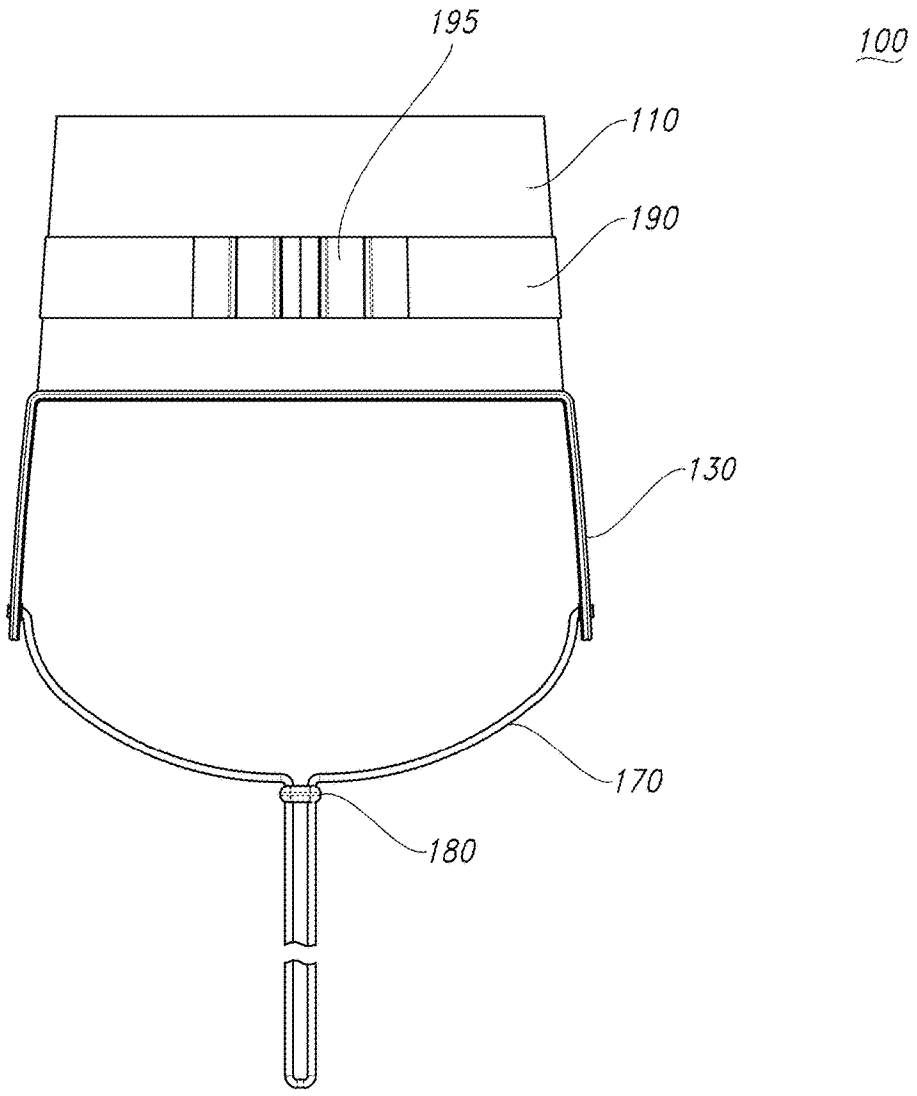
FIG. 17 is a front of the headwear of FIG. 1 in an actuated protective state in accordance with the present disclosure.

In accordance with various aspects of the present disclosure, the engagement strap 170 may also be used to further protect the user. In this regard, with reference in particular to FIG. 17, a user may pull down on the engagement strap 170 to bend the brim 130 towards a user's head. For example, when a golfer hears someone call out "Fore!" indicating a golf ball may be approaching or actually sees a golf ball approaching, instead of merely ducking or covering their head with their hands, this quick engagement allows the golfer to quickly pull the structurally reinforced protective sides of the brim 130 down over the sides and back of the user's head, allowing the protective headwear 100 to protect the vulnerable areas of the head and brain.

Thus, protective headwear 100 having the above-noted cage 140 and structural ribs 150 in accordance with the present disclosure, provides passive protection even when a user does not pull the engagement strap as well as additional active protection when the user pulls the sides of the brim 130 down over the sides and back of the user's head.

In accordance with various aspects of the present disclosure and with particular reference to FIG. 1, the protective headwear 100 further comprises a belt 190. The belt can be either or both of decorative and functional. For example, the belt 190 can be of different colors, designs and materials and/or may have words and logos displayed on it. The belt 190 can also provide additional functions. For example, the belt 190 may comprise material (e.g., heavy duty canvas or leather) that offers additional protection from a ball or other projectile. The belt 190 may include a holder 195. The holder 195 can include one or more appropriately sized loops that can act as golf tee holders, pen or pencil holders, divot tools, and other common items.

Finally, it will be apparent to those skilled in the art that various modifications and variations can be made in the present disclosure without departing from the spirit or scope of the disclosure. Thus, it is intended that the present disclosure cover the modifications and variations of this disclosure provided they come within the scope of the appended claims and their equivalents.

Likewise, numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications may be made, especially in matters of structure, deposition materials, elements, components, shape, size, and arrangement of parts including combinations within the principles of the invention, to the full extent indicated by the broad, general meaning of the terms in which the appended claims are expressed. To the extent that these various modifications do not depart from the spirit and scope of the appended claims, they are intended to be encompassed therein.

I claim:

1. A Protective headwear for a user, comprising:

an elliptical crown with an upper end and a lower end;

a top with a core layer adjacent thereto, the top attached to the upper end of the elliptical crown;

a circular brim attached to the lower end of the elliptical crown;

a cage coincident with and inside the elliptical crown;

circumferential structural ribs extending continuously along the entire circular brim and coplanar with the brim sandwiched between layers forming the brim; and an engagement strap, wherein pulling the engagement strap is configured to bend the brim over at least one side of the user's head for protecting the at least one side of the user's head.

2. The protective headwear of claim 1, wherein the core layer comprises an energy absorbing material.

3. The protective headwear of claim 1, further comprising a fitting insert.

4. The protective headwear of claim 1, wherein the engagement strap further comprises a cord lock for tightening the engagement strap.

5. The protective headwear of claim 1, wherein the cage comprises a rigid or a semi-rigid material.

6. The protective headwear of claim 1, wherein the circumferential structural ribs comprise a semi-rigid material.

7. The protective headwear of claim 1, further comprising a belt.

8. The protective headwear of claim 7, wherein the belt further comprises a holder.

9. The protective headwear of claim 8, wherein the holder comprises at least one of a golf tee holder and a pencil holder.

10. The protective headwear of claim 1, wherein at least one of the elliptical crown, the top, and the brim comprise a flexible material.

* * * * *